US005570529A

United States Patent [19]

Amelino

[11] Patent Number: 5,570,529

[45] Date of Patent: Nov. 5, 1996

[54] TORQUE-LIMITING WEAPON MOUNT AND WEAPON SYSTEM UTILIZING THE MOUNT

[75] Inventor: Victor R. Amelino, Redondo Beach, Calif.

[73] Assignee: Hughes Aircraft Company, Los Angeles, Calif.

[21] Appl. No.: 478,149

[22] Filed: Jun. 7, 1995

[51] Int. Cl.[6] ..... F41G 1/38

[52] U.S. Cl. ..... 42/101; 42/100

[58] Field of Search ..... 42/101, 100; 33/233, 33/250; 362/110; 292/305

[56] References Cited

U.S. PATENT DOCUMENTS

| | | | |
|---|---|---|---|
| 1,837,290 | 12/1931 | Redfield | 33/247 |
| 2,585,985 | 2/1952 | Anderson | 33/50 |
| 2,659,150 | 11/1953 | Feerick | 33/50 |
| 2,803,907 | 8/1957 | Weaver | 42/1 |
| 3,276,127 | 10/1966 | Abrahamson | 33/5 D |
| 4,021,954 | 5/1977 | Crawford | 42/1 ST |
| 4,328,624 | 5/1982 | Ross | 33/245 |
| 4,742,635 | 5/1988 | Ruger et al. | 42/101 |
| 4,742,636 | 5/1988 | Swan | 42/101 |
| 5,070,637 | 12/1991 | French | 42/101 |

*Primary Examiner*—Charles T. Jordan
*Assistant Examiner*—Meena Chelliah
*Attorney, Agent, or Firm*—Michael W. Sales; Wanda K. Denson-Low

[57] ABSTRACT

A sight is affixed to a rail on a receiver of a weapon by a torque-limiting weapon mount. Force is applied to clamp the sight to the rail by the relative movement of two inclined ramps, one on a rotating knob and the other on a nut whose turning generates the clamping force. The torque, and thence the force, that can be applied in attaching the sight is limited by the selection of a spring and by steps at the ends of the two inclined ramps that prevent a clamping force greater than that permitted by the spring force when the knob is turned.

18 Claims, 4 Drawing Sheets

TORQUE-LIMITING WEAPON MOUNT AND WEAPON SYSTEM UTILIZING THE MOUNT

BACKGROUND OF THE INVENTION

This invention relates to the mounting of an optical sight to a rail on a receiver of a weapon, and, more particularly, to limiting the torque and force that can be applied in the mounting.

Optical sights utilizing enlarging optics and/or specialized optics such as an infrared imager can be mounted to a hand-held, shoulder-supported weapon such as a rifle. The optical sight is mounted with its optics directed generally parallel to the barrel of the weapon to provide rough sighting of the rifle toward a target. Fine adjustments are made using adjustment features built into the optical sight itself.

The weapon has a rail built into its receiver that extends as closely parallel to the barrel as possible. The optical sight has a corresponding mount with an engagement to the rail such as a slot. To mount the optical sight to the rifle, the slot of the optical sight is engaged to the rail on the weapon receiver. The optical sight is moved forwardly or rearwardly along the receiver by sliding the engagement on the rail, to a position that is serviceable and comfortable for the user of the rifle. A set screw extending between the rail and the optical sight mount is tightened so that the optical sight will not slide along the rail during service.

This type of mounting arrangement is widely used on sporting and military weapons, and for both rifles and pistols. While operable for many applications, it has drawbacks in other situations. When the set screw is tightened, lateral forces are created between the weapon receiver and the optical sight. Because the weapon receiver has a more substantial structure than does the optical sight, the resulting deformation typically occurs in the optical sight. The deformation of the optical sight, in turn, can create inaccuracy in the aiming of the weapon.

Apparatus such as mounting rings have been developed to reduce the deformation of the optical sight when it is mounted to the rail. Such techniques are generally limited to relatively small-diameter, regularly configured optical sights. There remains a need for an approach for mounting an optical sight to a weapon which minimizes the likelihood of damage or unacceptable deformation to the optical sight. The present invention fulfills this need, and further provides related advantages.

SUMMARY OF THE INVENTION

The present invention provides a torque-limiting optical sight mount and a weapon system using the mount. The mount permits an optical sight to be readily attached to, and later detached from, a rail on a weapon. The mounting torque and thence the mounting force is limited to a preselected value. Overtightening of the mounting and the optical sight is prevented, an important advantage when the optical sight is to be mounted in difficult or stressful situations. Limiting of the mounting torque also avoids loss of boresight adjustment of the optical sight during mounting and detaching of the optical sight.

In accordance with the invention, a weapon mount comprises a clamping bar, a clamping head in facing but spaced-apart relationship to the clamping bar, a tightening knob, and means for forcing the clamping bar toward the clamping head by operating the tightening knob and for limiting the maximum force that may be applied between the clamping bar and the clamping head. The means for drawing and for limiting includes a pair of inclined ramps in facing relation to each other, one of the inclined ramps operable to apply a force to the clamping bar and the other of the inclined ramps being driven by the tightening knob.

More specifically, a weapon mount comprises a tightening assembly including a nut having an internally threaded nut bore extending therethrough between a first end of the nut and a second end of the nut, and further having a nut bore axis. There is a clamping bar adjacent to the first end of the nut and an inclined nut ramp defining the second end of the nut. The inclined nut ramp start at a first axial location relative to the nut bore axis and ends at a second axial location relative to the nut bore axis. A nut axial step terminates the inclined nut ramp at the second axial location and extends from the second axial location toward the first axial location. The weapon mount includes a tightening knob disposed adjacent to the second end of the nut, comprising a knob body having a knob bore extending therethrough between a first end of the knob and a second end of the knob, and further having a knob bore axis coincident with the nut bore axis. The tightening knob further includes an inclined knob ramp defining the first end of the knob and disposed in facing relation to the inclined nut ramp. The inclined knob ramp starts at a first axial location relative to the knob bore axis and ends at a second axial location relative to the knob bore axis. A knob axial step terminates the inclined knob ramp at the second axial location and extends from the second axial location relative to the knob bore axis toward the first axial location relative to the knob bore axis. The inclined knob ramp and knob axial step together have a shape conformal to a shape of the inclined nut ramp and the nut axial step. There is an internal shoulder within the knob bore, oriented to face the second end of the knob. A shaft extends through the nut bore and into the knob bore. The shaft has a first end and a second end and is externally threaded in that portion lying within the nut bore. A clamping head is retained to the first end of the shaft in facing but spaced-apart relationship to the clamp rag bar. A spring overlies the shaft, the spring having a first end engaged to the internal shoulder within the knob bore and a second end retained to the second end of the shaft.

In this preferred embodiment, during mounting the spring generates a reaction force between the clamping bar and the clamping head. The reaction force increases as the knob is turned and the inclined ramps slide past each other. The maximum torque and force are reached when the bottom of the knob ramp reaches the top of the nut ramp. This maximum torque cannot be exceeded, because further turning of the knob causes the knob ramp to fall over the housing step, resulting in a reduced spring compression and reduced torque, but without a reduction in the clamping force. The clamps are readily disengaged by mining the knob in the opposite direction so that the two steps abut and force the nut to turn in the opposite direction.

Further in accordance with the invention, a weapon system comprises a rifle including a receiver, a barrel affixed to the receiver, a rail affixed to the receiver and extending parallel to the barrel, an optical sight, and a weapon mount according to the invention as described previously.

The present invention provides a mount that is preferably used to affix an optical sight to a weapon such that preselected loading values cannot be exceeded. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
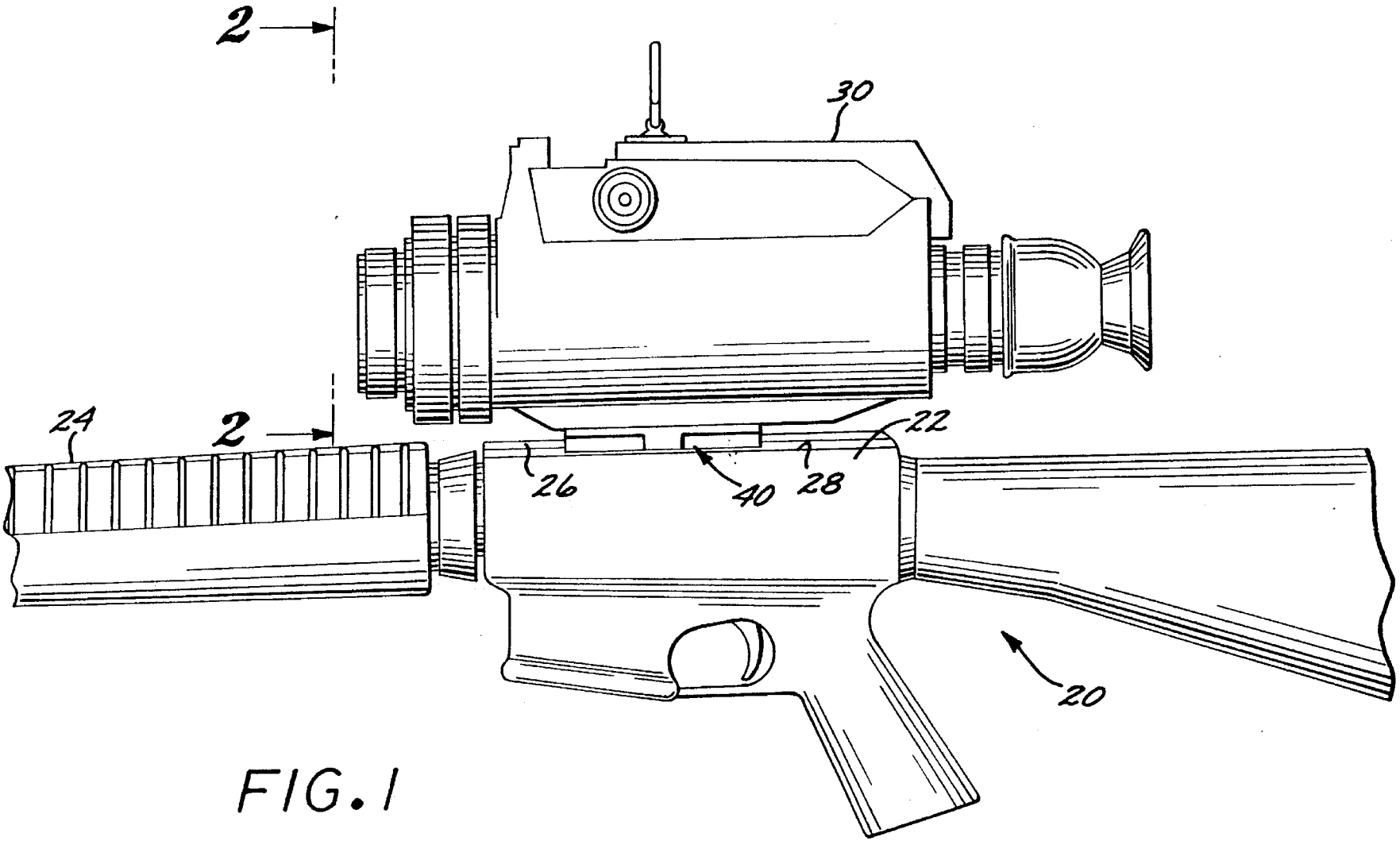
FIG. 1 is a perspective view of a weapon system utilizing the mounting approach of the invention.
Figure 2:
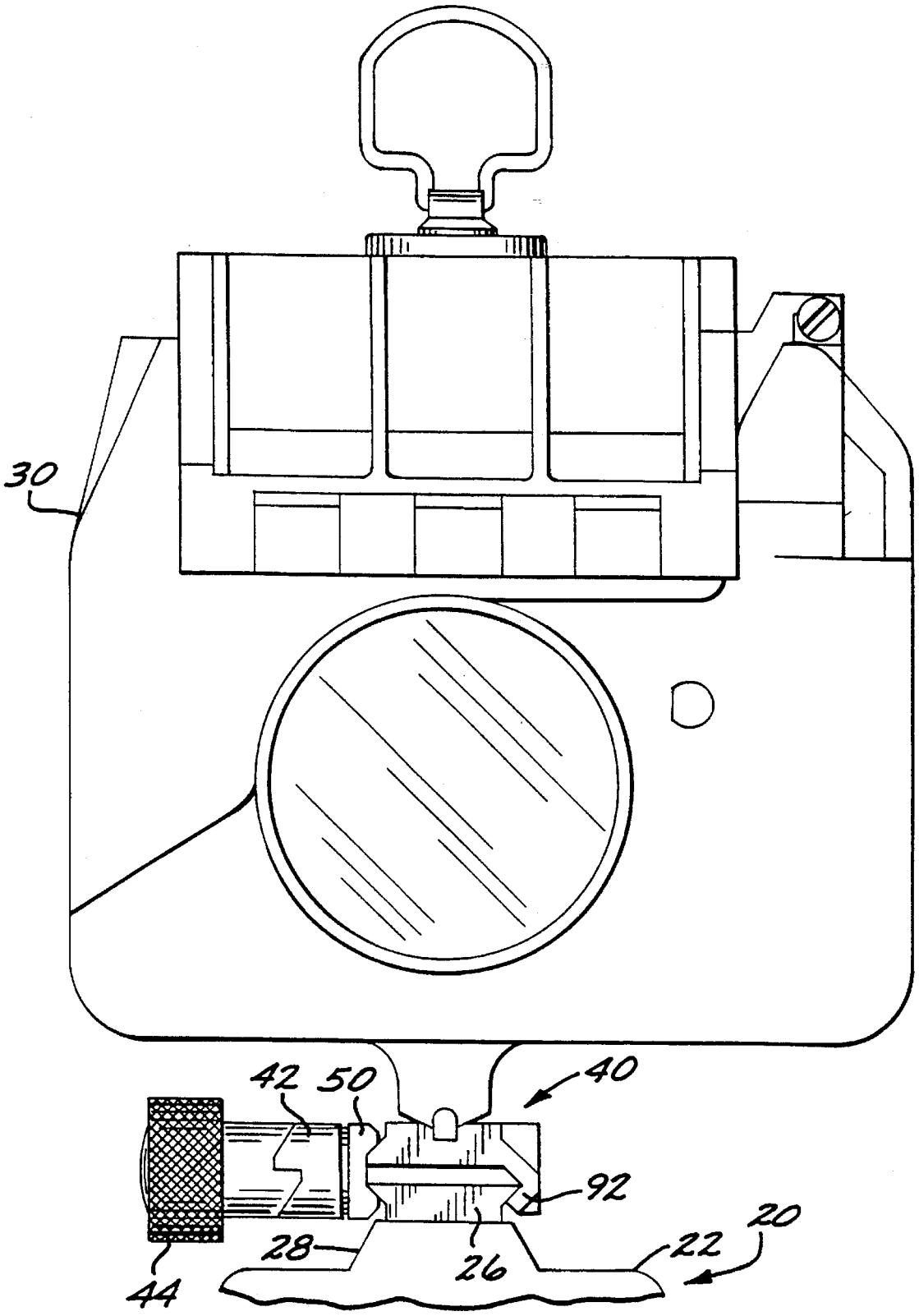
FIG. 2 is a schematic sectional view of the weapon system of FIG. 1, taken generally along lines 2—2.

FIG. 1 depicts a weapon in the form of a rifle 20, in this case a military M-16 rifle, and FIG. 2 shows a pertinent portion of the rifle in sectional view. The rifle 20 includes a receiver 22 in which the mechanical operating mechanism of the rifle is located, and a barrel 24 affixed to the receiver 22. A rail 26 is affixed to a top 28 of the receiver 22, to mount an optical sight 30 thereon. In the depicted case, the optical sight 30 is a thermal imaging sight, but it may be a visible light, enlarging optics sight as well. There are other elements of the rifle 20, which are not pertinent to the present invention.

Figure 3:
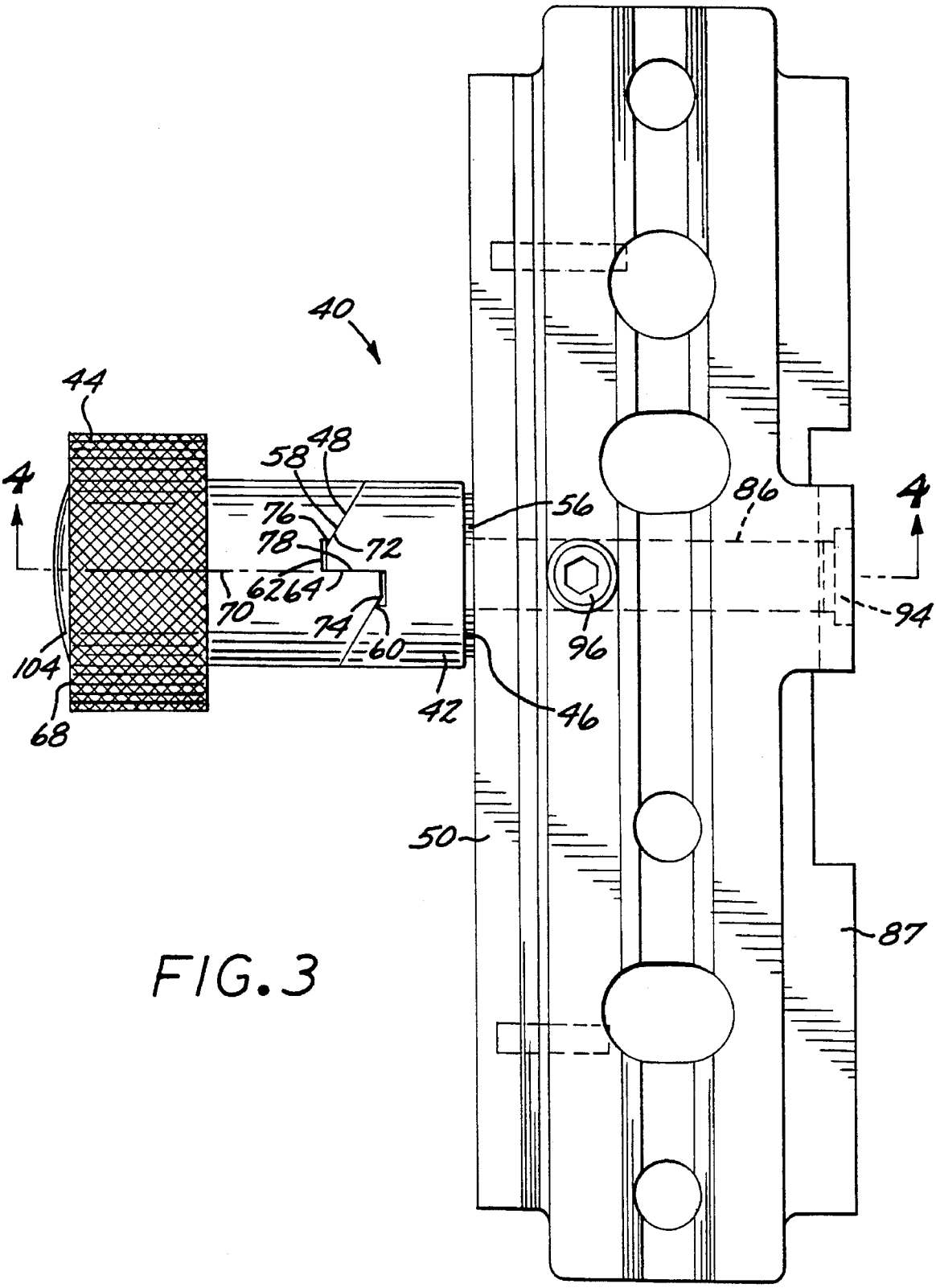
FIG. 3 is an enlarged plan view of the optical sight mount.
Figure 4:
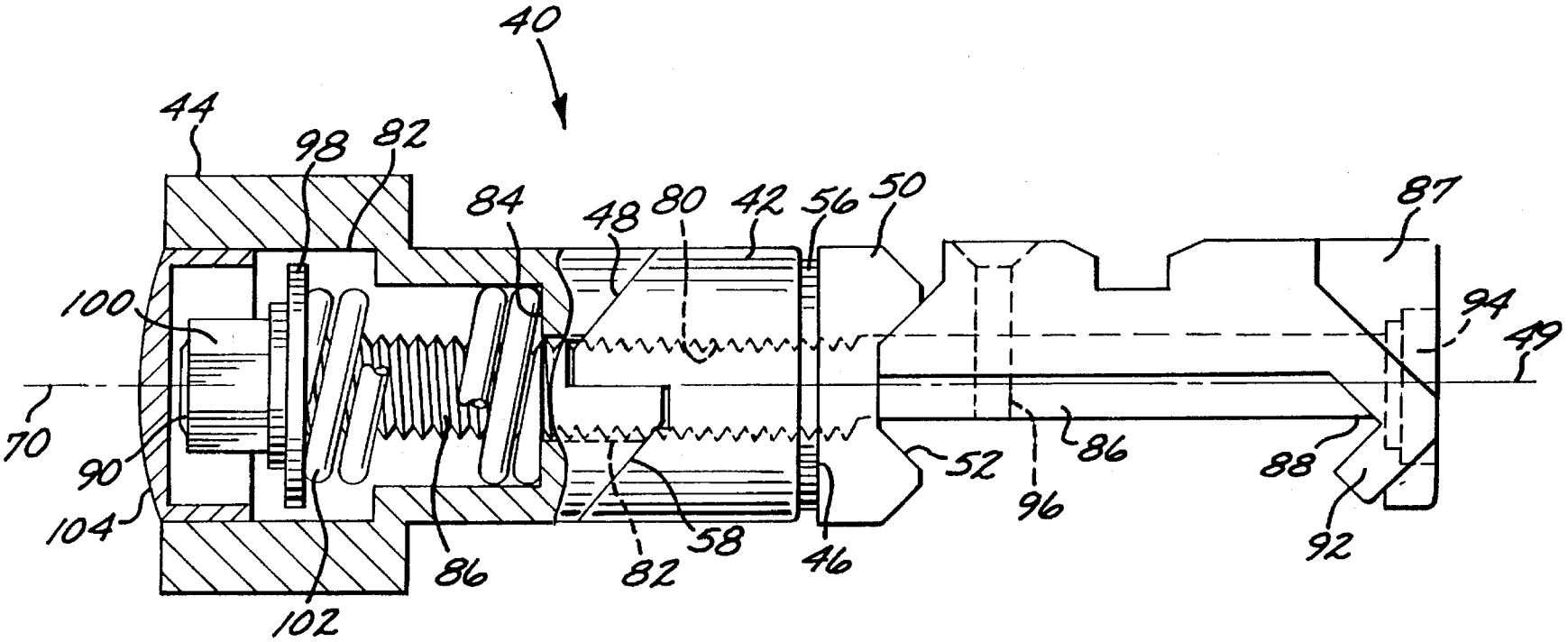
FIG. 4 is an enlarged sectional view of the torque-limiting structure of the optical sight mount, taken generally on line 4—4 of FIG. 3.

FIGS. 3 and 4 illustrate a weapon mount 40 used to mount the optical sight 30 to the rail 26, in greater detail. The weapon mount 40 includes a generally cylindrical nut 42 having a first end 46 and a second end 48, and a nut bore axis 49. A tightening knob 44 is positioned axially adjacent to the second end 48 of the nut 42. The tightening knob 44 is generally cylindrical but with two different diameters, a first diameter the same as the outer diameter of the nut 42 at the end adjacent to the nut 42, and an enlarged diameter remote from the nut 42, which may be knurled to permit easy grasping and turning of the knob 44. A clamping bar 50 having a shaped clamping end 52 is disposed adjacent to the first end 46 of the nut 42, with a washer 56 therebetween. The washer 56 is made of a low fiction material, preferably polytetrafluoroethylene (teflon), to permit the nut 42 to turn easily against the clamping bar 50.

The second end 48 of the nut 42 is defined by an inclined nut ramp 58 which starts at a first axial location 60 relative to the nut bore axis 49 and ends at a second axial location 62 relative to the nut bore axis 49. A nut axial step 64 terminates the inclined nut ramp 58 and extends from the second axial location 62 to the first axial location 60. Each inclined nut ramp 58 preferably extends for 90° around the circumference of the nut 42, and there are four such ramps 58, arranged in an end-to-end fashion, present at the second end 48 of the nut 42. Other arrangements such as a single ramp extending 360° or two ramps extending 180° can be used.

The tightening knob 44 has a first end 66 and a second end 68, and a knob bore axis 70. The knob bore axis 70 is coincident with the nut bore axis 49. The first end 66 of the knob 44 is defined by an inclined knob ramp 72 which starts at a first axial location 74 relative to the knob bore axis 70 and ends at a second axial location 76 relative to the knob bore axis 70. A knob axial step 78 terminates the inclined knob ramp 72 and extends from the second axial location 76 to the first axial location 74. The inclined knob ramp 72 is in a facing relationship to the inclined nut ramp 58, and conforms in shape to the inclined nut ramp 58. Thus, if each inclined nut ramp 58 extends for 90° around the circumference of the nut 42, so also does each inclined knob ramp 72.

A nut bore 80 extends through the nut 42 coaxial with and centered on the nut bore axis 49. The nut bore 80 is preferably a single cylindrical bore of constant diameter, with internal threads. A smooth (not internally threaded) knob bore 82 extends through the tightening knob 44 coaxial with and centered on the knob bore axis 70. The knob bore 82 has two different diameters along its length. There is a first, smaller diameter adjacent to the first end 66 of the knob 44, and a second, larger diameter adjacent to the second end 68 of the knob 44. Between the two regions of different diameter is an internal shoulder 84 oriented to face toward the second end 68 of the knob 44.

A shaft 86 extends through the nut bore 80 and the knob bore 82. The shaft 86 has a first end 88 and a second end 90. The shaft 86 is externally threaded along that portion of its length that lies within the nut bore 80, so that it is threadably engaged to the internal threads of the nut 42. A base 87 having a clamping head 92 is retained to the shaft 86, preferably by a press fit, a radial enlargement 94 of the first end 88 that is press fit into the base 87, and a retaining screw 96 extending through the base 87 and into a transverse threaded bore in the shaft 86.

The second end 90 of the shaft 86 is preferably threaded. A washer 98 overlies the shaft 86 adjacent to its second end 90, and a retaining nut 100 is engaged to the threaded second end 90 of the shaft 86. A coil spring 102 lies within the knob bore 82 and overlying the shaft 86.

The coil spring 102 reacts between the shoulder 84 and the washer 98. This reaction force causes the inclined nut ramp 58 to be forced against the inclined knob ramp 72 with a force that is determined by the spring constant of the spring 102 and the degree of compression of the spring 102. The degree of compression of the spring 102 is established by the degree to which the knob 44 is rotated, or, stated alternatively, the relative position of the inclined ramps 58 and 72.

When the weapon mount is to be used, the clamping bar 50 and the clamping head 92 are placed over the rail 26, so that the rail 26 is captured therebetween. During subsequent tightening of the weapon mount to the rail, the clamping head 92 remains substantially stationary and the clamping bar 50 is forced toward the clamping head 92 by the mechanism as discussed next.

Initially, the first axial location 74 of the knob 44 lies adjacent to the first axial location 60 of the nut 42, as shown in FIGS. 3 and 4. As the knob 44 is mined, the inclined knob ramp 72 rides against the inclined nut ramp 58, causing the nut 42 to turn in the same direction that the knob 44 is turned. The turning of the nut 42 causes forces the clamping bar 50 against the rail 26.

As the knob 44 is mined, the spring 102 is compressed, increasing the clamping force applied between the clamping bar 50 and the clamping head 92. As the knob 44 is mined past the point where the upper ends of the ramps 58 and 72 engage, the knob axial step 78 falls over the nut axial step 64. The force on the spring 102 is reduced, but without loosening the nut 42 and its clamping force. The shapes of the ramps 58 and 72 can be tapered, as by making their tops flattened, so that the user of the weapon mount 40 can easily sense when the maximum spring force is reached.

The maximum permitted torque and thence the maximum permitted clamping force are established during the assembly of the weapon mount 40 by the degree to which the spring 102 is initially preloaded with the knob and nut in the positions illustrated in FIGS. 3 and 4. The preload is determined by the extent to which the retaining nut 100 is tightened onto the shaft 86 to compress the spring 102. A cover 104 is usually provided to prevent the position of the retaining nut 100 on the shaft 86 from being altered during service.

The steps 64 and 78 also permit the easy loosening and disengagement of the clamps 50 and 92 from the rail 26 when desired. The knob 44 is rotated to position the knob 44 relative to the nut 42 in the manner illustrated in FIGS. 3 and 4, with the steps 64 and 78 in facing relation to each other. The knob is thereafter rotated oppositely to the direction of rotation to tighten the clamp, so that the steps 64 and 78 engage each other. The nut 42 is thereby loosened, as are the clamps 50 and 92.

The weapon mount of the invention thus provides an approach for affixing an optical sight to the mounting rail of a weapon, which ensures that the clamping force cannot exceed a preselected level, even in a difficult situation, and permits disengagement to be easily accomplished. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A weapon mount, comprising:

a tightening assembly, comprising a nut having an internally threaded nut bore extending therethrough between a first end of the nut and a second end of the nut, and further having a nut bore axis, a clamping bar adjacent to the first end of the nut, an inclined nut ramp defining the second end of the nut, the inclined nut ramp starting at a first axial location relative to the nut bore axis and ending at a second axial location relative to the nut bore axis, and a nut axial step terminating the inclined nut ramp at the second axial location and extending from the second axial location toward the first axial location;

a tightening knob disposed adjacent to the second end of the nut, comprising a knob body having a knob bore extending therethrough between a first end of the knob and a second end of the knob, and further having a knob bore axis coincident with the nut bore axis, an inclined knob ramp defining the first end of the knob and disposed in facing relation to the inclined nut ramp, the inclined knob ramp starting at a first axial location relative to the knob bore axis and ending at a second axial location relative to the knob bore axis, a knob axial step terminating the inclined knob ramp at the second axial location and extending from the second axial location relative to the knob bore axis toward the first axial location relative to the knob bore axis, the inclined knob ramp and knob axial step together having a shape conformal to a shape of the inclined nut ramp and the nut axial step, and an internal shoulder within the knob bore, the internal shoulder being oriented to face the second end of the knob;

a shaft extending through the nut bore and into the knob bore, the shaft having a first end and a second end and being externally threaded in that portion lying within the nut bore;

a clamping head retained to the first end of the shaft, the clamping head being in facing but spaced-apart relationship to the clamping bar; and a spring overlying the shaft, the spring having a first end engaged to the internal shoulder within the knob bore and a second end retained to the second end of the shaft.

2. The weapon mount of claim 1, further including a nut washer disposed between the nut body and the clamping bar.

3. The weapon mount of claim 1, wherein the nut and the tightening knob are externally generally cylindrical.

4. The weapon mount of claim 1, wherein the second end of the shaft is threaded, and further including a washer overlying the shaft, and a retaining nut engaged to the threaded second end of the shaft.

5. The weapon mount of claim 1, wherein the inclined nut ramp extends one-fourth of the distance around the periphery of the nut.,

6. A weapon mount, comprising:

a clamping bar;

a clamping head in facing but spaced-apart relationship to the clamping bar;

a tightening knob; and means for forcing the clamping bar toward the clamping head by operating the tightening knob and for limiting the maximum force that may be applied between the clamping bar and the clamping head, the means for drawing and for limiting including a pair of inclined ramps in facing relation to each other, one of the inclined ramps operable to apply a force to the clamping bar and the other of the inclined ramps being driven by the tightening knob.

7. The weapon mount of claim 6, wherein the means for drawing and for limiting further includes means for forcing the two inclined ramps into contact with each other.

8. The weapon mount of claim 6, wherein the means for drawing and for limiting further includes a step in each of the inclined ramps.

9. The weapon mount of claim 6, wherein one of the inclined ramps extends one-fourth of the way around a circumference of the tightening knob.

10. A weapon system, comprising:

a rifle including a receiver, a barrel affixed to the receiver, and a rail affixed to the receiver and extending parallel to the barrel;

an optical sight; and a weapon mount, comprising a clamping bar;

a clamping head in facing but spaced-apart relationship to the clamping bar, a tightening knob, and means for forcing the clamping bar toward the clamping head by operating the tightening knob and for limiting the maximum force that may be applied between the clamping bar and the clamping head, the means for drawing and for limiting including a pair of inclined ramps in facing relation to each other, one of the inclined ramps operable to apply a force to the clamping bar and the other of the inclined ramps being driven by the tightening knob.

11. The weapon system of claim 10, wherein the means for forcing and for limiting includes a nut having an internally threaded nut bore extending therethrough between a first end of the nut and a second end of the nut, and further having a nut bore axis, a clamping bar adjacent to the first end of the nut, an inclined nut ramp defining the second end of the nut, the inclined nut ramp starting at a first axial location relative to the nut bore axis and ending at a second axial location relative to the nut bore axis, and a nut axial step terminating the inclined nut ramp at the second axial location and extending from the second axial location toward the first axial location, a tightening knob disposed adjacent to the second end of the nut, comprising a knob body having a knob bore extending therethrough between a first end of the knob and a second end of the knob, and further having a knob bore axis coincident with the nut bore axis, an inclined knob ramp defining the first end of the knob and disposed in facing relation to the inclined nut ramp, the inclined knob ramp starting at a first axial location relative to the knob bore axis and ending at a second axial location relative to the knob bore axis, a knob axial step terminating the inclined knob ramp at the second axial location and extending from the second axial location relative to the knob bore axis toward the first axial location relative to the knob bore axis, the inclined knob ramp and knob axial step together having a shape conformal to a shape of the inclined nut ramp and the nut axial step, and an internal shoulder within the knob bore, the internal shoulder being oriented to face the second end of the knob;

a shaft extending through the nut bore and into the knob bore, the shaft having a first end and a second end and being externally threaded in that portion lying within the nut bore;

a clamping head retained to the first end of the shaft, the clamping head being in facing but spaced-apart relationship to the clamping bar; and a spring overlying the shaft, the spring having a first end engaged to the internal shoulder within the knob bore and a second end retained to the second end of the shaft.

12. The weapon system of claim 11, further including a nut washer disposed between the nut body and the clamping bar.

13. The weapon system of claim 11, wherein the nut and the tightening knob are externally generally cylindrical.

14. The weapon system of claim 11, wherein the second end of the shaft is threaded, and further including a washer overlying the shaft, and a retaining nut engaged to the threaded second end of the shaft.

15. The weapon system of claim 11, wherein the inclined nut ramp extends one-fourth of the distance around the periphery of the nut.

16. The weapon system of claim 10, wherein the means for drawing and for limiting further includes means for forcing the two inclined ramps into contact with each other.

17. The weapon system of claim 10, wherein the means for drawing and for limiting further includes a step in each of the inclined ramps.

18. The weapon system of claim 10, wherein one of the inclined ramps extends one-fourth of the way around a circumference of the tightening knob.

* * * * *